US009923291B2

(12) United States Patent
Van der Steen

(10) Patent No.: US 9,923,291 B2
(45) Date of Patent: Mar. 20, 2018

(54) AUDIO JACK CONNECTOR HAVING COMPRESSIVE CONTACTS

(71) Applicant: FOXCONN INTERCONNECT TECHNOLOGY LIMITED, Grand Cayman (KY)

(72) Inventor: Hendrikus P. G. Van der Steen, Den Dungen (NL)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/173,942

(22) Filed: Jun. 6, 2016

(65) Prior Publication Data

US 2016/0359250 A1 Dec. 8, 2016

(30) Foreign Application Priority Data

Jun. 5, 2015 (CN) ..... 2015 1 0301685

(51) Int. Cl.

| | |
|---|---|
| ***H01R 24/58*** | (2011.01) |
| ***H01R 12/72*** | (2011.01) |
| ***H01R 12/70*** | (2011.01) |
| ***H01R 13/50*** | (2006.01) |
| *H01R 24/60* | (2011.01) |
| *H01R 12/58* | (2011.01) |
| *H01R 13/24* | (2006.01) |
| *H01R 107/00* | (2006.01) |

(52) U.S. Cl.

CPC ..... *H01R 12/722* (2013.01); *H01R 12/7029* (2013.01); *H01R 12/721* (2013.01); *H01R 13/50* (2013.01); *H01R 24/58* (2013.01); *H01R 12/58* (2013.01); *H01R 13/245* (2013.01); *H01R 24/60* (2013.01); *H01R 2107/00* (2013.01)

(58) Field of Classification Search

CPC ..... H01R 24/58; H01R 24/60
USPC ..... 439/668, 669
See application file for complete search history.

(56) References Cited

U.S. PATENT DOCUMENTS

| | | | | |
|---|---|---|---|---|
| 7,534,146 | B2 * | 5/2009 | Chien | H01R 24/58 439/668 |
| 2015/0263443 | A1 * | 9/2015 | Zhang | H01R 12/72 439/78 |
| 2016/0056591 | A1 * | 2/2016 | Zhao | H01R 12/721 439/668 |

FOREIGN PATENT DOCUMENTS

| | | |
|---|---|---|
| CN | 201130789 | 10/2008 |
| CN | 203434343 | 2/2014 |

* cited by examiner

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An audio jack connector, assembled to a printed circuit board having a number of conductive pads, includes an insulative housing having a number of receiving grooves and a number of terminals received in the receiving grooves. Each audio terminal includes an elastic portion having a number of compressive contacts laterally. The elastic portion is pressed laterally by the printed circuit board so that the compressive contacts are contacted with the conductive pads.

20 Claims, 7 Drawing Sheets

AUDIO JACK CONNECTOR HAVING COMPRESSIVE CONTACTS

BACKGROUND OF THE INVENTION

1. Field of the Invention

The present disclosure relates generally to an audio jack, and more particularly to an audio jack connector having a number of compressive contacts.

2. Description of Related Arts

China Patent No. 203434343 discloses a sink-type audio jack connector which includes an insulative housing with a receiving room, a number of terminals received in the insulative housing, a shielding shell enclosing the insulative housing, and a waterproof case enclosing the insulative housing and shielding shell. Each of the terminals includes a soldering portion exposed out of the waterproof case and bent upwardly or downwardly to solder with a printed circuit board. The relative position of the circuit board and the audio jack connector is uniquely determined and can not be flexibly adjusted according to needs.

An improved audio jack connector is desired to compensate for the disadvantages in prior technology.

SUMMARY OF THE INVENTION

Accordingly, an object of the present invention is to provide an audio jack connector having a number of compressive contacts.

To achieve the above object, an audio jack, mounted to a printed circuit board (PCB) comprises a plurality of conductive pads, comprises: an insulative housing defining a plurality of receiving grooves and a plurality of terminals inserted into the receiving groove. Each terminal includes an elastic portion having a plurality of compressive contacts located at a lateral side. The elastic portion is pressed laterally by the PCB to connect the compressive contacts electrically with the conductive pads.

Other objects, advantages and novel features of the invention will become more apparent from the following detailed description when taken in conjunction with the accompanying drawings.

DETAILED DESCRIPTION OF THE PREFERRED EMBODIMENT

Figure 1:
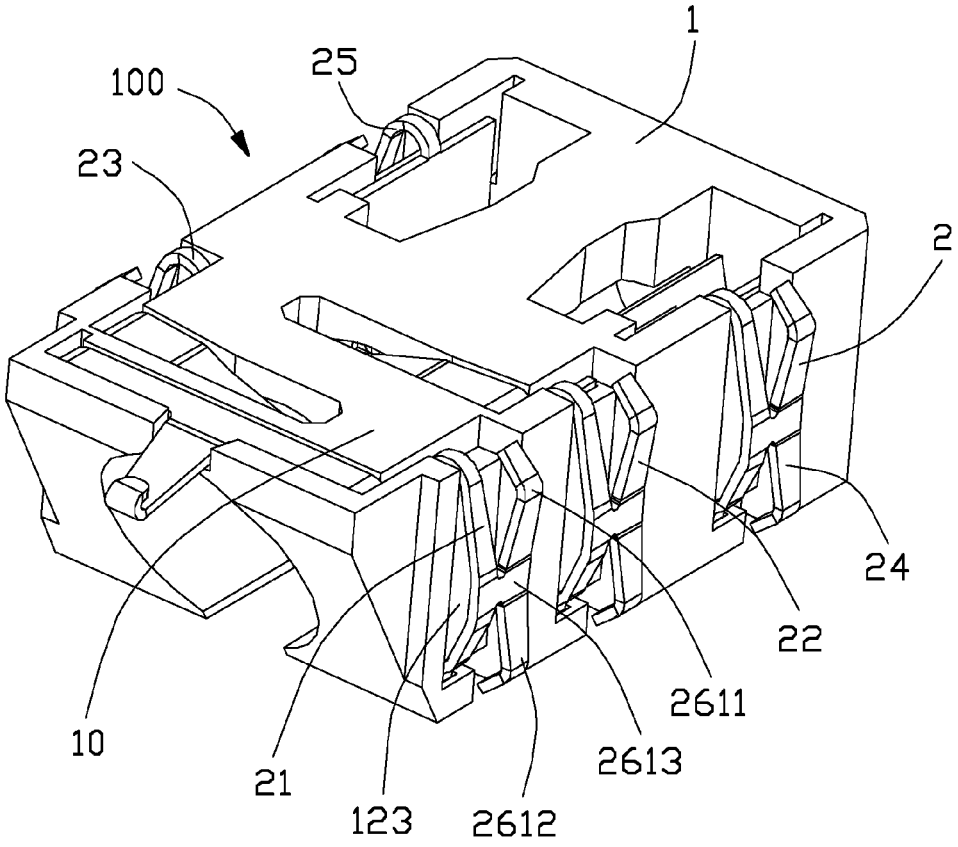
FIG. 1 is a perspective, assembled view of an audio jack connector of the present invention.
Figure 2:
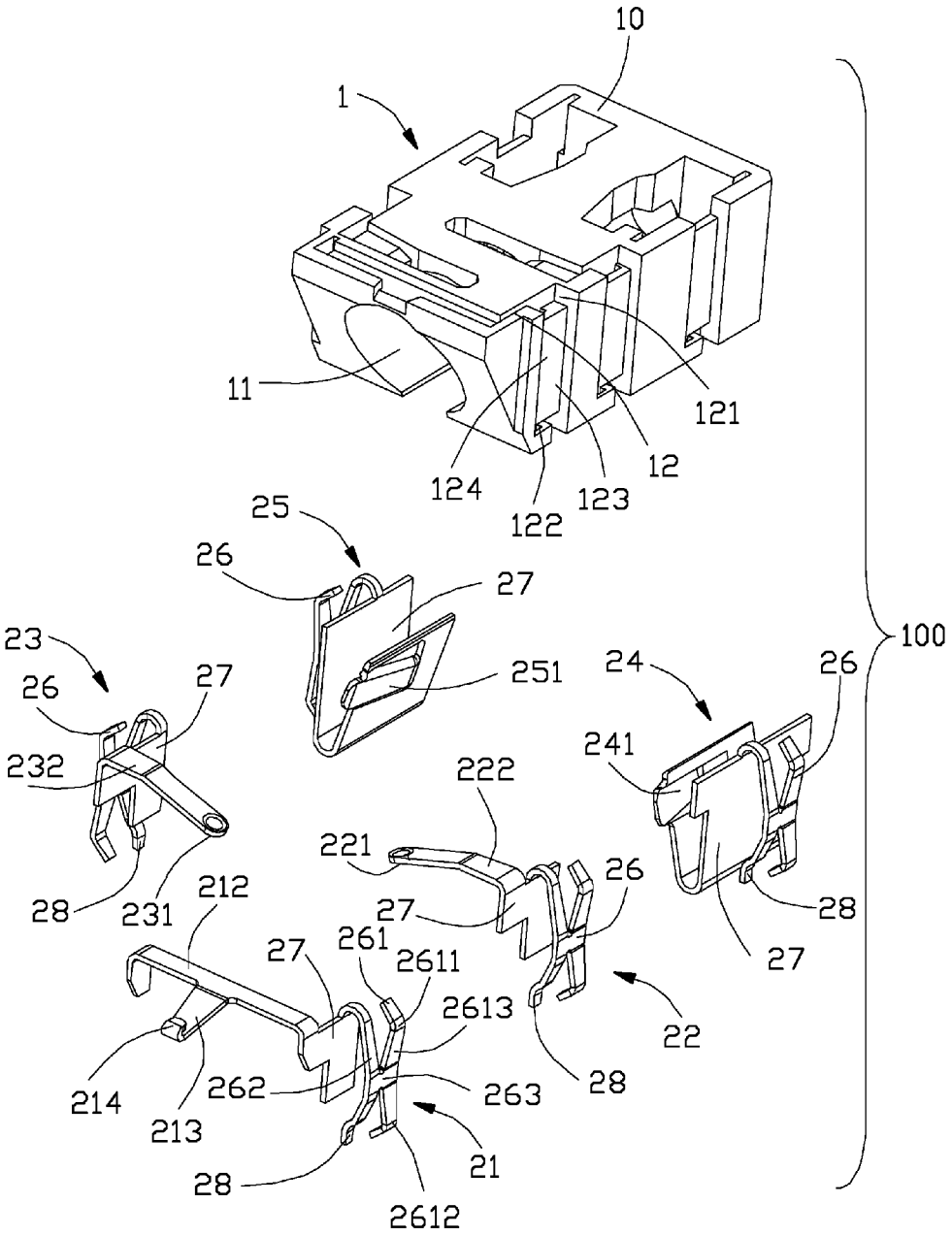
FIG. 2 is a perspective, exploded view of the audio jack connector taken from FIG. 1.
Figure 3:
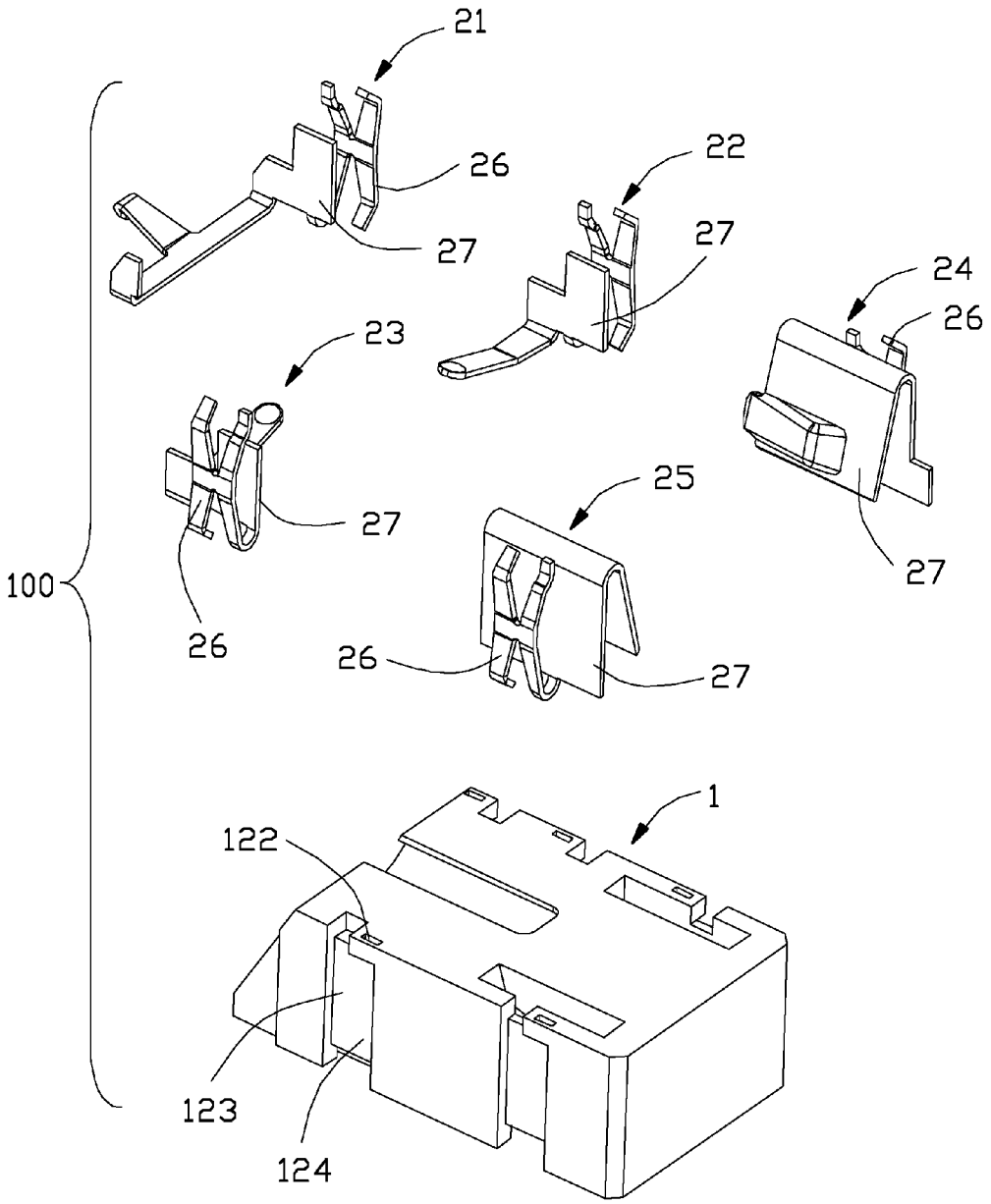
FIG. 3 is another view of the audio jack connector of FIG. 2.
Figure 4:
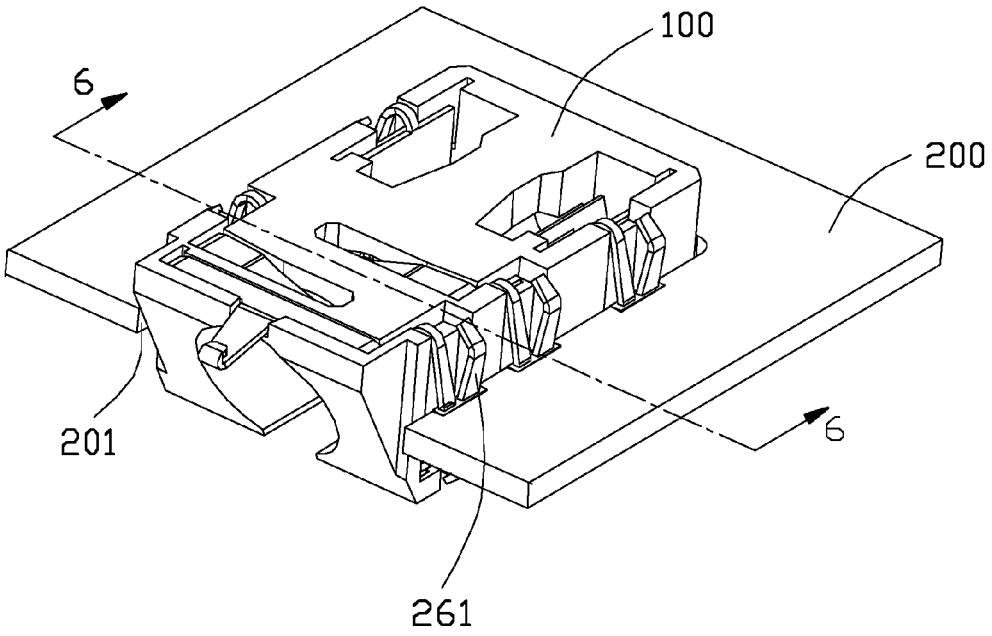
FIG. 4 is a perspective, assembled view of the audio jack connector mounting to the printed circuit board.

Reference will now be made in detail to the preferred embodiment of the present invention.

Referring to FIGS. 4 to 7, an audio jack connector 100 is sink mounted to a printed circuit board 200 having an opening or cutout 201. The printed circuit board 200 includes a plurality of conductive pads 202 formed upon a peripheral interior edge (not labeled) of the printed circuit board 200 which surrounds and inwardly faces the opening 201. The audio jack connector 100 includes an insulative housing 1 having a number of receiving grooves 12 and a number of audio terminals 2 received in the receiving grooves 12. The audio terminals 2 include a first terminal 21, a second terminal 22, a third terminal 23, a forth terminal 24 and a fifth terminal 25.

Referring to FIGS. 1 to 4, the insulative housing 1 defines an insertion surface 10 and a receiving room or mating cavity 11. Each receiving groove 12 includes an interposed groove 121 extending through the insertion surface 10, an insertion groove 122 extending through a lower surface of the insulative housing 1 and an outer groove 123. The outer groove 123 includes an outer wall 124 outside of the interposed groove 121.

Each audio terminal 2 includes an elastic portion or connecting section 26 for electrically and mechanically connecting to the conductive pads 202, an interposed section or retention section 27 for securing the terminal 2 in position in the housing 1, and an insertion portion 28 for stabilizing the connecting section 26. The elastic portion 26 includes an elastic beam 261, an interlocking arm 262 and a connecting portion 263 connected the elastic beam 261 and the interlocking arm 262. The interposed section 27 is connected to one end of the interlocking arm 262. The insertion portion 28 is connected to the other end of the interlocking arm 262. The elastic portion 26 includes a number of compressive contacts located at a lateral side including a middle compressive contact 2613 located at the connecting portion 263, a top compressive contact 2611 and a bottom compressive contact 2612 both laterally protruded from the elastic beam 261. The top compressive contact 2611 and the bottom compressive contact 2612 are located at two sides of the middle compressive contact 2613. The top compressive contact 2611 and the bottom compressive contact 2612 are bent outwardly from the elastic beam 261 and formed as V-shaped.

The first terminal 21 further includes a first extension arm 212, a first clasp arm 213 extending forwardly from the middle of the first extension arm 212 and a first contacting portion or mating section 214 positioned at a front end of the first clasp arm 213 and extending into the receiving room 11. The first contacting portion 214 is bent upwardly to form an arc-shaped surface contacted with the audio plug.

The second terminal 22 further includes a second extension arm 222 extended laterally from the interposed section 27 and a second contacting portion or mating section 221 having a spherical surface and located at a free end of the second extension arm 222.

The third terminal 23 further includes a third extension arm 232 extending laterally from the interposed section 27 and a third contacting portion or mating section 231 having a spherical surface and located at a free end of the third extension arm 232.

The interposed section 27 of the forth terminal 24 is bent as U-shaped sheet. The elastic portion 26 of the forth terminal 24 is contacted with the right sheet of the interposed section 27. The forth terminal 24 further includes a forth contacting portion or mating section 241 in a V shape located at a left sheet of the interposed section 27.

The interposed section 27 of the fifth terminal 25 is bent as U-shaped sheet. The elastic portion 26 of the fifth terminal 25 is contacted with the left sheet of the interposed section 27. The fifth terminal 25 further includes a fifth contacting portion 251 in a V shape located at the right sheet of the interposed section 27.

When the audio terminals 2 are inserted into the receiving grooves 12, the interposed sections 27 of audio terminals 2 are inserted into the interposed grooves 121 through the insertion surface 10. The insertion portions 28 is inserted into the insertion grooves 122 from the insertion surface 10 to assemble the audio terminals 2 to the insulative housing 1 via the elastic portion 26 plug-in the insulative housing 1. The insertion directions of the interposed section 27 and the insertion portion 28 are the same. The elastic portion 26 is separated from the outer wall 124 and gets suspended in the outer groove 123.

Figure 5:
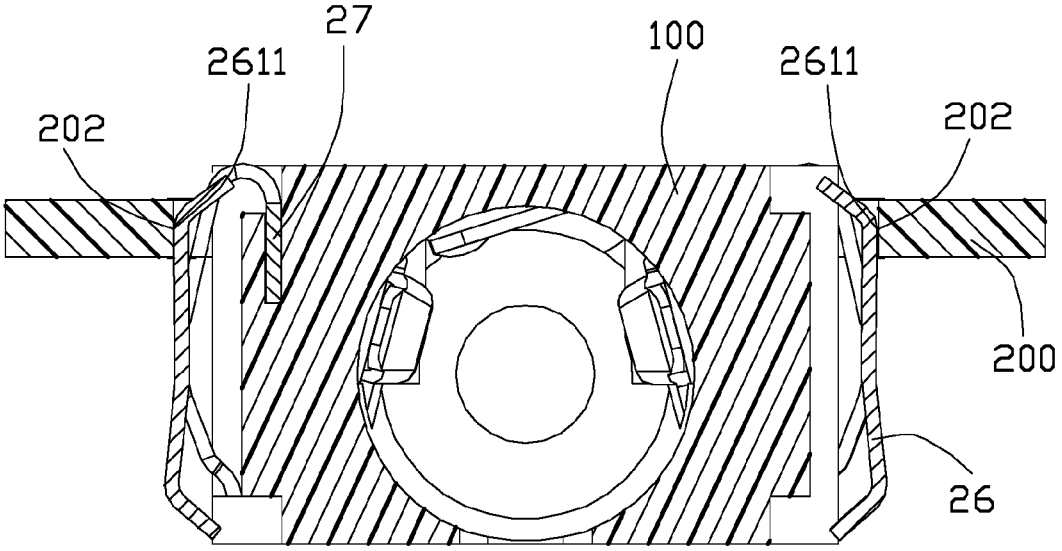
FIG. 5 is a cross-sectional view of the printed circuit board assembled to the top of the audio jack.

Referring to FIG. 5, when the printed circuit board 200 is mounted to the upper position of the audio jack connector 100, and the elastic portion 26 is laterally pressed. The top compressive contact 2611 is contacted with the conductive pad 202 of the printed circuit board 200.

Figure 6:
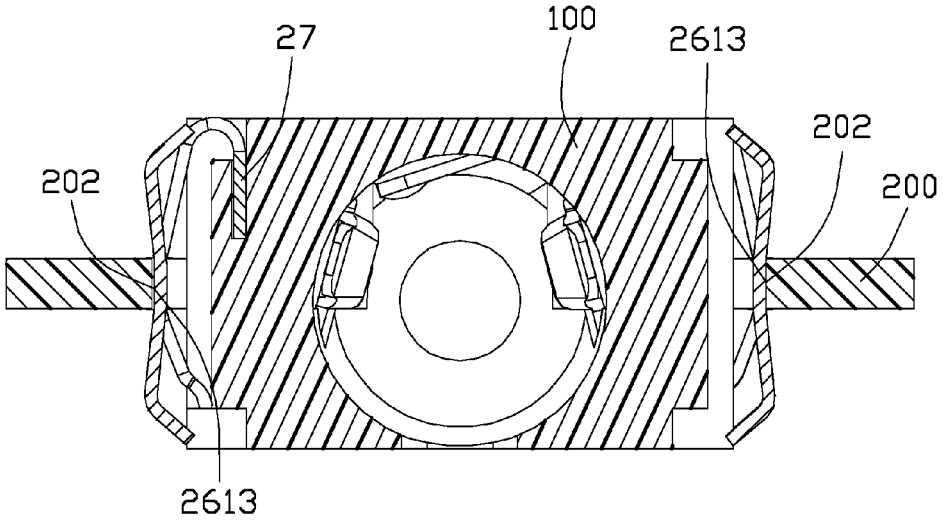
FIG. 6 is a cross-sectional view of the printed circuit board assembled to the middle position of the audio jack connector taken along line 6-6 in FIG. 4.

Referring to FIG. 6, when the printed circuit board 200 is mounted to the middle position of the audio jack connector 100, and the elastic portion 26 is laterally pressed. The middle compressive contact 2613 is contacted with the conductive pad 202 of the printed circuit board 200.

Figure 7:
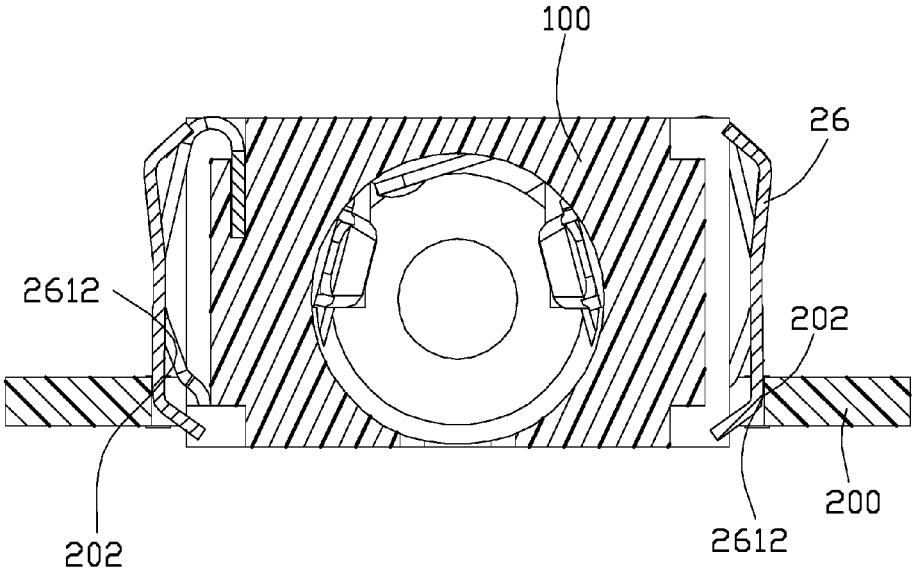
FIG. 7 is a cross-sectional view of the printed circuit board assembled to the bottom of the audio jack.

Referring to FIG. 7, when the printed circuit board 200 is mounted to the lower position of the audio jack connector 100, and the elastic portion 26 is laterally pressed. The bottom compressive contact 2612 is connected with the conductive pad 202 of the printed circuit board 200.

In the process of the assembling, the insertion portion 28 moves in the insertion groove 122 along the vertical direction. In brief, the electrical connector 100 is received within the opening 201 wherein the elastic connecting sections 26 of the terminals 2 are exposed upon two opposite lateral side faces of the housing for mechanical and electrical engagement with the corresponding pads 202 of the printed circuit board 200 in a variable position along the vertical direction for easy compliance with the height limitations required by the whole electronic device where the printed circuit board 200 is positioned.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An audio jack connector, mounted to a printed circuit board (PCB) having a plurality of conductive pads, comprising:

an insulative housing defining a plurality of receiving grooves; and a plurality of terminals inserted into the receiving grooves, each terminal comprising an elastic portion having a plurality of compressive contacts located at a lateral side, the elastic portion being pressed laterally by the PCB to connect at least one of the compressive contacts electrically with the conductive pads.

2. The audio jack connector as claimed in claim 1, wherein the insulative housing defines an insertion surface, each receiving groove comprises an interposed groove, each audio terminal comprises an interposed section, and the interposed section is inserted into the interposed groove from the insertion surface to cantilever the elastic portion outside of the housing.

3. The audio jack connector as claimed in claim 2, wherein each terminal comprises a contacting portion connected to the interposed section to contact with a mating connector.

4. The audio jack connector as claimed in claim 2, wherein each receiving groove comprises an outer groove outside of the interposed groove and an outer wall, and the elastic portion is separated from the outer wall and suspended partially in the outer groove.

5. The audio jack connector as claimed in claim 2, wherein the elastic portion comprises an elastic beam, an interlocking arm, and a connecting portion connected with the elastic beam and the interlocking arm, the compressive contacts are partially located at the elastic beam, and the interposed section is connected with one end of the interlocking arm.

6. The audio jack connector as claimed in claim 5, wherein the compressive contacts comprise a middle compressive contact located at the connecting portion, a top compressive contact and a bottom compressive contact both laterally protruded at the elastic beam, and the top compressive contact and the bottom compressive contact are located at two sides of the middle compressive contact along a vertical direction.

7. The audio jack connector as claimed in claim 5, wherein each receiving groove comprises an insertion groove, each terminal comprises an insertion portion connected with the other end of the interlocking arm and inserted into the insertion groove, the interposed section and the insertion portion are inserted along a same direction, and the insertion portion is movable in the insertion groove along the vertical direction when the elastic portion is pressed.

8. An electrical connector assembly for mating with a plug, comprising:

a printed circuit board defining opposite upper and bottom surfaces in a vertical direction, and forming a cutout surrounded by a peripheral interior edge of the printed circuit board;

a plurality of conductive pads formed upon the peripheral interior edge;

an electrical connector received within the cutout, and including:

an insulative housing forming a mating cavity forwardly communicating with an exterior in a front-to-back direction perpendicular to said vertical direction, and further forming two opposite lateral side faces opposite to each other in a transverse direction perpendicular to both said vertical direction and said front-to-back direction;

a plurality of terminals respectively disposed in the housing, each of said terminals including a retention section secured to the housing, a resilient mating section located inside of the retention section and into the mating cavity for mating with the plug, and an elastic connecting section located outside of the retention section and exposed upon a corresponding lateral side face to mechanically and electrically engage with the corresponding conductive pads, respectively; wherein said electrical connector is arranged in variable positions with regard to the printed circuit board in the vertical direction while keeping the mechanical and electrical engagement between the elastic connecting sections and the corresponding conductive pads, respectively.

9. The electrical connector assembly as claimed in claim 8, wherein the retention section extends in a vertical plane defined by the vertical direction and the front-to-back direction.

10. The electrical connector assembly as claimed in claim 9, wherein said housing forms a plurality of vertical slots to receive the corresponding retentions sections therein, respectively.

11. The electrical connector assembly as claimed in claim 10, wherein each of the terminals is downwardly assembled into the housing in the vertical direction.

12. The electrical connector assembly as claimed in claim 11, wherein each of said terminals further includes an interlocking arm between the retention section and the connecting section to stabilize the connecting section.

13. The electrical connector assembly as claimed in claim 12, wherein said interlocking arm and said connecting section are side by side arranged with each other and linked by a transversely extending connecting portion.

14. The electrical connector assembly as claimed in claim 8, wherein the elastic connecting section is deformable/compressible in the transverse direction.

15. The electrical connector assembly as claimed in claim 8, wherein the elastic connecting section includes an upper compressible contact and a bottom compressible contact linked by a connecting portion to commonly form a V-shaped configuration.

16. The electrical connector assembly as claimed in claim 8, wherein the elastic connecting section extends in the vertical direction with tapered guiding portions at two opposite ends for allowing the connector to move relative to the printed circuit board in the vertical direction.

17. An electrical connector for being received within a cutout of and being moveable relative to a printed circuit board in a vertical direction, comprising:

an insulative housing forming a mating cavity forwardly communicating with an exterior in a front-to-back direction perpendicular to said vertical direction, and further forming two opposite lateral side faces opposite to each other in a transverse direction perpendicular to both said vertical direction and said front-to-back direction;

a plurality of terminals respectively disposed in the housing, each of said terminals including a retention section secured to the housing, a resilient mating section located inside of the retention section and into the mating cavity for mating with the plug, and an elastic connecting section located outside of the retention section and exposed upon a corresponding lateral side face to respectively mechanically and electrically engage with corresponding conductive pads formed on a peripheral edge of the printed circuit board around said cutout; wherein said elastic connecting section is deformable and compressible in the transverse direction.

18. The electrical connector as claimed in claim 17, wherein the retention section of each of said terminals extends in a vertical plane defined by said vertical direction and said front-to-back direction, and said housing forms a plurality of insertion grooves to receive the retention sections of the corresponding terminals, respectively.

19. The electrical connector as claimed in claim 18, wherein each of said terminals is inserted into the corresponding insertion groove in the vertical direction.

20. The electrical connector as claimed in claim 17, wherein the elastic connecting section forms a V-shaped configuration with opposite top and bottom contacting points in the vertical direction so as to define a range in which the corresponding conductive pad is moveable in the vertical direction.

* * * * *